US008378276B2

(12) United States Patent
Lam

(10) Patent No.: US 8,378,276 B2
(45) Date of Patent: Feb. 19, 2013

(54) TIME-TO-GO MISSILE GUIDANCE METHOD AND SYSTEM

(75) Inventor: Vincent C. Lam, Grand Prairie, TX (US)

(73) Assignee: Lockheed Martin Corp, Bethesda, MD (US)

( * ) Notice: Subject to any disclaimer, the term of this patent is extended or adjusted under 35 U.S.C. 154(b) by 1368 days.

(21) Appl. No.: 11/683,652

(22) Filed: Mar. 8, 2007

(65) Prior Publication Data

US 2010/0274415 A1 Oct. 28, 2010

Related U.S. Application Data

(63) Continuation of application No. 11/010,527, filed on Dec. 13, 2004, now Pat. No. 7,264,198.

(51) Int. Cl.

| | |
|---|---|
| ***F41G 7/00*** | (2006.01) |
| ***F42B 15/01*** | (2006.01) |
| ***G06F 17/10*** | (2006.01) |
| *F42B 15/00* | (2006.01) |

(52) U.S. Cl. ..... 244/3.1; 244/3.11; 244/3.15; 244/3.19; 701/1; 701/3; 701/300; 701/301

(58) Field of Classification Search ..... 244/3.1–3.3; 89/1.11; 342/61–68, 70–72, 104–113, 118–147, 342/159, 175, 195, 450–465; 701/300–302, 701/1, 3–18; 340/901, 902, 903
See application file for complete search history.

(56) References Cited

U.S. PATENT DOCUMENTS

| | | | | |
|---|---|---|---|---|
| 3,698,811 | A * | 10/1972 | Weil | 244/3.16 |
| 3,741,502 | A | 6/1973 | Schroader et al. | 244/3.13 |
| 3,964,695 | A | 6/1976 | Harris | 244/3.16 |
| 4,456,862 | A | 6/1984 | Yueh | 244/3.14 |
| 4,492,352 | A | 1/1985 | Yueh | 244/3.15 |
| 4,494,202 | A | 1/1985 | Yueh | 701/302 |
| 4,502,650 | A | 3/1985 | Yueh | 244/3.15 |
| 5,071,087 | A | 12/1991 | Gray | 244/3.15 |
| 5,249,157 | A * | 9/1993 | Taylor | 340/903 |
| 5,429,322 | A | 7/1995 | Waymeyer | 244/3.15 |
| 5,435,503 | A * | 7/1995 | Johnson et al. | 244/3.15 |
| 5,464,174 | A * | 11/1995 | Laures | 244/3.11 |
| 5,660,355 | A | 8/1997 | Waymeyer | 244/3.15 |
| 5,696,347 | A | 12/1997 | Sebeny et al. | 244/3.15 |
| 5,848,764 | A | 12/1998 | Schneider | 244/3.15 |
| 6,142,412 | A * | 11/2000 | De Sa et al. | 244/3.16 |

(Continued)

FOREIGN PATENT DOCUMENTS

GB 2279444 A * 1/1995

OTHER PUBLICATIONS

Tom I. Riggs, Jr., "*Linear Optimal Guidance for Short Range Air-to-Air Missiles*", Proceedings of NAECON, vol. II, Oakland, MI, May 1979, pp. 757-764.

(Continued)

*Primary Examiner* — Bernarr Gregory
(74) *Attorney, Agent, or Firm* — Lee, Jorgensen, Pyle & Kewalramani

(57) ABSTRACT

A method and apparatus for guiding a vehicle to intercept a target is described. The method iteratively estimates a time-to-go until target intercept and modifies an acceleration command based upon the revised time-to-go estimate. The time-to-go estimate depends upon the position, the velocity, and the actual or real time acceleration of both the vehicle and the target. By more accurately estimating the time-to-go, the method is especially useful for applications employing a warhead designed to detonate in close proximity to the target. The method may also be used in vehicle accident avoidance and vehicle guidance applications.

50 Claims, 6 Drawing Sheets

U.S. PATENT DOCUMENTS

| | | | | |
|---|---|---|---|---|
| 6,244,536 | B1 * | 6/2001 | Cloutier | 244/3.19 |
| 6,302,354 | B1 | 10/2001 | Patera | 244/3.15 |
| 6,487,519 | B1 * | 11/2002 | O'Neill et al. | 342/159 |
| 7,137,588 | B2 * | 11/2006 | Humphrey | 244/3.15 |
| 7,264,198 | B2 | 9/2007 | Lam | 244/3.15 |

OTHER PUBLICATIONS

F. Williams Nesline and Paul Zarchan, "*A New Look at Classical vs. Modern Homing Missile Guidance*", J. Guidance and Control, vol. 4, No. 1, Jan.-Feb. 1981, pp. 78-85.

David G. Hull, Jerry J. Radke, and Rodney E. Mack, "*Time-To-Go Prediction for Homing Missiles Based on Minimum-Time Intercepts*", J. Guidance, vol. 14, No. 5, Sep.-Oct. 1991, pp. 865-871.

Gordon K. F. Lee, "*Estimation of the Time-To-Go Parameter for Air-to-Air Missiles*", J. Guidance, vol. 8, No. 2, Mar.-Apr. 1985, pp. 262-266.

Ching-Fang Liu, "*Modern Navigation, Guidance, and Control Processing*", Prentice Hall, 1991, pp. 606-609.

Cianne-Dong Yang and Chi-Chang Yang, "*Analytical Solution of Three-Dimensional Realistic True Proportional Navigation*", Journal of Guidance, Control, and Dynamics, vol. 19, No. 3, May-Jun. 1996, pp. 569-577.

* cited by examiner

TIME-TO-GO MISSILE GUIDANCE METHOD AND SYSTEM

This is a continuation of U.S. application Ser. No. 11/010,527 ("the '527 application"), entitled "Time-To-Go Missile Guidance Method And System", filed Dec. 13, 2004, in the name of the inventors Vincent Lam, now issued as U.S. Letters Patent 7,264,198. The earlier effective filing date of the '527 application is hereby claimed for all common subject matter. The '527 application is also hereby incorporated by reference in its entirety for all purposes as if expressly set forth verbatim herein.

FIELD OF THE INVENTION

The present invention relates to a method of and apparatus for guiding a missile. In particular, the present invention provides for a method of guiding a missile based upon the time of flight until the missile intercepts the target, i.e., the time-to-go.

BACKGROUND OF THE INVENTION

There is a need to estimate the time it will take a missile to intercept a target or to arrive at the point of closest approach. The time of flight to intercept or to the point of closest approach is known as the time-to-go $\tau$. The time-to-go is very important if the missile carries a warhead that should detonate when the missile is close to the target. Accurate detonation time is critical for a successful kill. Proportional navigation guidance does not explicitly require time-to-go, but the performance of the advanced guidance law depends explicitly on the time-to-go. The time-to-go can also be used to estimate the zero effort miss distance.

One method to estimate the flight time is to use a three degree of freedom missile flight simulation, but this is very time consuming. Another method is to iteratively estimate the time-to-go by assuming piece-wise constant positive acceleration for thrusting and piece-wise constant negative acceleration for coasting. Yet another method is to iteratively estimate the time-to-go based upon minimum-time trajectories.

Tom L. Riggs, Jr. proposed an optimal guidance method in his seminal paper "Linear Optimal Guidance for Short Range Air-to-Air Missiles" by (Proceedings of NAECON, Vol. II, Oakland, Mich., May 1979, pp. 757-764). Riggs' method used position, velocity, and a piece-wise constant acceleration to estimate the anticipated locations of a vehicle and a target/obstacle and then generated a guidance command for the vehicle based upon these anticipated locations. To ensure the guidance command was correct, Riggs' method repeatedly determined the positions, velocities, and piece-wise constant accelerations of both the vehicle and the target/obstacle and revised the guidance command as needed. Because Riggs' method did not consider actual, or real time acceleration in calculating the guidance command, a rapidly accelerating target/obstacle required Riggs' method to dramatically change the guidance command. As the magnitude of the guidance command is limited, (for example, a fin of a missile can only be turned so far) Riggs' method may miss a target that it was intended to hit, or hit an obstacle that it was intended to miss. Additionally, many vehicles and targets/obstacles can change direction due to changes in acceleration. Riggs' method, which provided for only piece-wise constant acceleration, may miss a target or hit an obstacle with constantly changing acceleration.

Computationally, the fastest methods use only missile-to-target range and range rate or velocity information. This method provides a reasonable estimate if the missile and target have constant velocities. When the missile and/or target have changing velocities, this simple method provides time-to-go estimates that are too inaccurate for warheads intended to detonate when the missile is close to the target.

FIG. 1 illustrates two different prior art methods for determining time-to-go. FIG. 1 shows a missile 100 with a net velocity v relative to the target at a missile-to-target angle relative to the LOS between the missile 100 and a target 104. The net velocity v is a function of both the missile 100 and the target 104 velocities. The missile-to-target range is shown as r. As such a target intercept scheme occurs in three-dimensional space, vectors will be shown in bold, while the magnitudes of such vectors will be shown as standard text.

Assuming the missile and target velocities are constant, the distance between the missile 100 and target 104 at time t is:

$$z=r+vt. \qquad \text{Eq. 1}$$

The miss distance is minimized when $$\frac{\partial(z\cdot z)}{\partial t}=0. \qquad \text{Eq. 2}$$

Substituting Eq. 1 into Eq. 2 yields:

$$r\cdot v+v\cdot vt=0. \qquad \text{Eq. 3}$$

Solving Eq. 3, the time-to-go $\tau$ is:

$$\tau=-\frac{v\cdot r}{v\cdot v}. \qquad \text{Eq. 4}$$

Eq. 4 yields the exact time-to-go if the missile 100 and target 104 have constant velocities.

The minimum missile-to-target position vector z can be obtained by substituting Eq. 4 into Eq. 1 resulting in:

$$z=\frac{(v\cdot v)r-(v\cdot r)v}{v\cdot v}=\frac{(v\times r)\times v}{v\cdot v}. \qquad \text{Eq. 5}$$

The zero-effort-miss distance, corresponding to the magnitude of the minimum missile-to-target position vector z, illustrated as point P in FIG. 1, is:

$$\|z\|=\left\|\frac{(v\times r)\times v}{v\cdot v}\right\|=\frac{v^2 r\sin\alpha}{v^2}=r\sin\alpha. \qquad \text{Eq. 6}$$

The prior art time-to-go formulation is simply:

$$\tau=-\frac{r}{\dot{r}}, \qquad \text{Eq. 7}$$

where $\dot{r}$ is the range rate. The difference between Eq. 4 and Eq. 7 is apparent in FIG. 1. Eq. 4 estimates the flight time for the missile 100 to reach the point of closest approach, P. Eq. 7, however, estimates the flight time for the missile 100 to reach point Q. If the missile 100 and target 104 have no acceleration, then Eq. 4 is exact. However, if a missile guidance system is trying to align the relative velocity with the LOS, the missile 100 is likely to travel the range r. In this case, Eq. 7 is more appropriate for estimating the time-to-go. On the other hand, if zero-effort-miss distance is needed by the missile guidance system, Eq. 4 is more appropriate. It must be emphasized that Eqs. 4 and 7 are only accurate when both the target 104 and the missile 100 have constant velocities.

A simple technique that includes the effect of acceleration by the missile 100 and/or the target 104 uses the piece-wise average acceleration along the LOS. The time-to-go $\tau$ using this technique by Riggs is calculated according to:

$$\tau = \frac{2r}{v_c + \sqrt{v_c^2 + 4a_m r}}, \quad \text{Eq. 8}$$

where $v_c = -\dot{r}$ the closing velocity, and $a_m$ is the piece-wise average acceleration along the LOS. When $a_m = 0$, then Eqs. 7 and 8 are the same. If $a_m$ is known, then the time-to-go can be obtained directly from Eq. 8. If $a_m$ is not known, the piece-wise constant acceleration is approximated as:

$$a_m = \frac{a_{max}(t_e - t_0) + a_{min}(t_f - t_e)}{\tau}, \quad \text{Eq. 9}$$

where $t_0$ is the initial time, $t_f$ is the terminal time, $t_e$ is the thrust-off time, $a_{max}$ is the average acceleration when the thrust is on from $t_0$ to $t_e$, and $a_{min}$ is the average acceleration (actually deceleration) primarily due to drag when the thrust is off from $t_e$ to $t_f$. Since the time-to-go estimate is a function of $a_m$ and $a_m$ is a function of time-to-go, an iterative solution is required.

OBJECT OF THE INVENTION

A first object of the invention is to provide a highly accurate method of estimating the time-to-go, which is not computationally time consuming. A further object of the invention is to provide a method of estimating the time-to-go that remains highly accurate even when the vehicle and/or target velocities change or at large vehicle-to-target angles.

Yet another object of the invention is to provide a highly accurate method of guiding a vehicle to intercept a target based on the time-to-go. Such a guidance method will not be computationally time consuming. The guidance method will also remain highly accurate in spite of changes in vehicle and/or target velocities and large vehicle-to-target angles.

These objects are implemented by the present invention, which takes actual, or real time acceleration into account when estimating the anticipated locations of a vehicle and a target/obstacle. By using actual acceleration information, the present invention can generate guidance commands that need only small adjustments, rather than requiring dramatic changes that may be difficult to accomplish. Furthermore, because the present invention more accurately anticipates the locations of the vehicle and the target/obstacle, the present invention provides more time for carrying out the guidance commands. This is especially useful as the small adjustments may be made at lower altitudes where aerodynamic surfaces, such as fins, are more responsive. In the thin air at higher altitudes, aerodynamic surfaces are less responsive, making dramatic changes more difficult.

Each of these methods can be incorporated in a vehicle and used for guiding or arming the vehicle. The method finds applicability in air vehicles such as missiles and water vehicles such as torpedoes. Vehicles using the invention may be operated either autonomously, or be provided additional and/or updated information during flight to improve accuracy.

While the invention finds application when a vehicle is intended to intercept a target, it also finds application when a vehicle is not intended to intercept a target. In particular, a further object of the invention is to guide a vehicle during accident avoidance situations. In like manner, another object of the invention is to guide a first vehicle relative to one or more other vehicles and/or obstacles. Such objects of the invention may readily be implemented by notifying a vehicle operator of potential accidents and/or the location of other vehicles and/or obstacles.

BRIEF DESCRIPTION OF THE DRAWINGS

The present invention is described in reference to the following Detailed Description and the drawings in which.

DETAILED DESCRIPTION OF THE PREFERRED EMBODIMENTS

Figure 1:
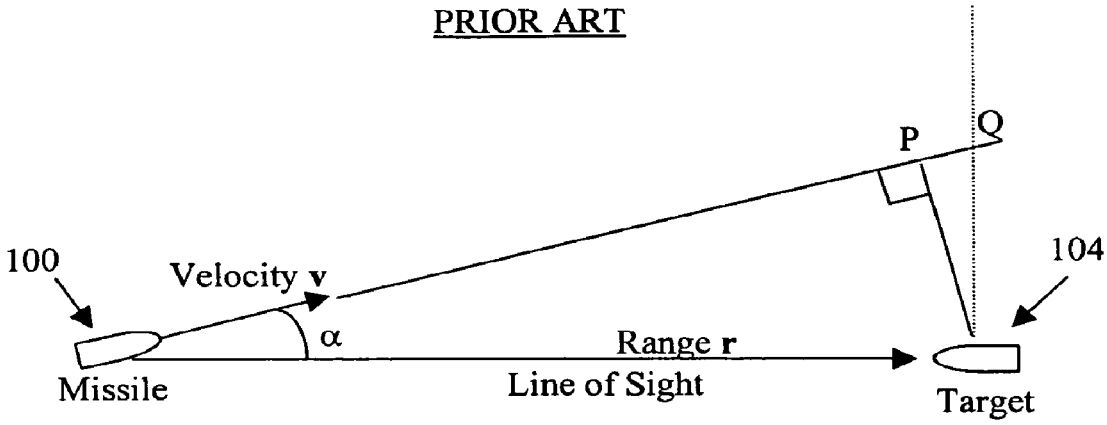
FIG. 1 shows a geometry of a vehicle-target engagement.

The following Detailed Description provides disclosure regarding two target interception embodiments. These embodiments provide two methods for estimating the time-to-go $\tau$ with differing degrees of accuracy, and corresponding different magnitudes of computational requirements.

First Embodiment

Deriving a more accurate time-to-go estimate that accounts for the actual or real time acceleration in the first embodiment begins by modifying the zero-effort-miss distance to include acceleration:

$$z = r + vt + \frac{1}{2}at^2, \quad \text{Eq. 10}$$

where a is the missile-to-target acceleration. As with the velocity v, the missile-to-target acceleration a is a net acceleration and is a function of both the missile and target accelerations. Substituting Eq. 10 into Eq. 2 yields:

$$\frac{1}{2}a\cdot at^3+\frac{3}{2}a\cdot vt^2+(a\cdot r+v\cdot v)t+v\cdot r=0. \quad \text{Eq. 11}$$

The following equations (Eqs. 12-14) simplify the remainder of the analysis.

$$v\cdot r=vr\cos\alpha \quad \text{Eq. 12}$$

$$a\cdot r=ar\cos\beta \quad \text{Eq. 13}$$

$$a\cdot v=av\cos\gamma \quad \text{Eq. 14}$$

When $a\neq 0$, the following additional equations (Eqs. 15, 16) further simplify the analysis.

$$\bar{v}=\frac{v}{a} \quad \text{Eq. 15}$$

$$\bar{r}=\frac{r}{a} \quad \text{Eq. 16}$$

Substituting Eqs. 12-16 into Eq. 11 yields:

$$t^3+3\bar{v}\cos\gamma t^2+2(\bar{r}\cos\beta+\bar{v}^2)t+2\overline{vr}\cos\alpha=0. \quad \text{Eq. 17}$$

Defining $\tau$ as the time-to-go solution, Eq. 17 becomes:

$$(t-\tau)(t^2+bt+c)=0. \quad \text{Eq. 18}$$

Eq. 18 has only one real solution, when $b^2-4c<0$. Expanding Eq. 18 yields:

$$t^3+(b-\tau)t^2+(c-b\tau)t-c\tau=0. \quad \text{Eq. 19}$$

Equating Eqs. 17 and 19 yields:

$$b-\tau=3\bar{v}\cos\gamma, \quad \text{Eq. 20}$$

$$c-b\tau=2(\bar{r}\cos\beta+\bar{v}^2), \quad \text{and Eq. 21}$$

$$-c\tau=2\overline{vr}\cos\alpha. \quad \text{Eq. 22}$$

Rewriting Eq. 20 as:

$$b=3\bar{v}\cos\gamma+\tau, \quad \text{Eq. 23}$$

and substituting Eq. 23 into Eq. 21 yields:

$$c=2(\bar{r}\cos\beta+\bar{v}^2)+3\bar{v}\cos\gamma\tau+\tau^2. \quad \text{Eq. 24}$$

Assuming $$-\frac{\pi}{2}\leq\beta\leq\frac{\pi}{2} \text{ and } -\frac{\pi}{2}\leq\gamma\leq\frac{\pi}{2},$$

then $c>0$. Returning to Eq. 22, a real positive time-to-go $\tau$ for $c>0$ occurs when:

$$\overline{vr}\cos\alpha<0. \quad \text{Eq. 25}$$

Rewriting Eq. 24 as $$c=2\bar{r}\cos\beta+\left(\tau+\frac{3\bar{v}\cos\gamma}{2}\right)^2+\left(\frac{8-9\cos^2\gamma}{4}\right)\bar{v}^2, \quad \text{Eq. 26}$$

c will be positive if:

$$-\frac{\pi}{2}\leq\beta\leq\frac{\pi}{2} \text{ and} \quad \text{Eq. 27}$$

$$\sqrt{\frac{8}{9}}>\cos\gamma. \quad \text{Eq. 28}$$

Combining Eqs. 23 and 24 yields:

$$b^2-4c=-(8-9\cos^2\gamma)\bar{v}^2-8\bar{r}\cos\beta-6\bar{v}\cos\gamma-3\tau^2. \quad \text{Eq. 29}$$

Satisfying Eqs. 27 and 28 also ensures that $b^2-4c$ is negative. In this case, only one real solution to the time-to-go $\tau$ can be obtained from Eq. 17:

$$\tau=\left(-\frac{e}{2}+\sqrt{\frac{e^2}{4}+\frac{d^3}{27}}\right)^{\frac{1}{3}}+\left(-\frac{e}{2}-\sqrt{\sqrt{\frac{e^2}{4}+\frac{d^3}{27}}}\right)^{\frac{1}{3}}-\bar{v}\cos\gamma, \quad \text{Eq. 30}$$

where $$d=2(\bar{r}\cos\beta+\bar{v}^2)-3\bar{v}^2\cos^2\gamma, \text{ and} \quad \text{Eq. 31}$$

$$e=2\bar{v}^3\cos^3\gamma-2\bar{v}\cos\gamma(\bar{r}\cos\beta+\bar{v}^2)+2\overline{vr}\cos\alpha. \quad \text{Eq. 32}$$

For $$\frac{e^2}{4}+\frac{d^3}{27}\leq 0,$$

there are three possible solutions for the time-to-go $\tau$:

$$\tau=2\sqrt{\frac{-d}{3}}\cos\left\{\frac{1}{3}\cos^{-1}\left(\frac{-e}{2\sqrt{-d^3/27}}+\varphi\right)\right\}-\bar{v}\cos\gamma, \quad \text{Eq. 33}$$

where $\phi=0$, $2\pi/3$, and $4\pi/3$. For the initial estimated value of the time-to-go, the angle $\phi$ is used that yields the solution closest to that predicted by Eq. 7. For all subsequent iterations, the time-to-go solution that is closest to the previously estimated time-to-go is used.

The result leads to zero-effort-miss with acceleration compensation guidance (ZEMACG). The corresponding acceleration command for the ZEMACG system is the equation:

$$A=\frac{r}{\tau^2}+\frac{v}{\tau}+\frac{1}{2}a, \quad \text{Eq. 34}$$

in which the estimated time-to-go $\tau$ found in Eqs. 30 or 33 is then inserted. The numerical examples below show that ZEMACG is an improvement over proportional navigation guidance (PNG).

The advantage of Eq. 30 over Eq. 8 is the actual or real time acceleration direction is accounted for more properly. For true proportional navigation acceleration, the acceleration is perpendicular to the LOS. In this case $a_m=0$, and therefore Eq. 8 is the same as Eq. 7. Although $\beta=0$ when the acceleration is perpendicular to the LOS, the contribution of acceleration in Eq. 30 to the time-to-go is through the term containing $\gamma$. The difference between Eqs. 8 and 30 will be illustrated by an example below.

The zero-effort-miss position vector z using Eq. 34 is:

$$z = r + v\tau + \frac{1}{2}a\tau^2. \quad \text{Eq.35}$$

The zero-effort-miss position vector z yields a zero-effort-miss distance of:

$$\|z\| = \sqrt{\left(r + v\tau + \frac{1}{2}a\tau^2\right)\cdot\left(r + v\tau + \frac{1}{2}a\tau^2\right)} \quad \text{Eq. 36}$$

$$= \sqrt{r^2 + (2vr\cos\alpha)\tau + (ar\cos\beta + v^2)\tau^2 + (av\cos\gamma)\tau^3 + \frac{a^2\tau^4}{4}}. \quad \text{Eq. 37}$$

Second Embodiment

In the second embodiment, equations based upon three-dimensional relative motion will be developed leading to an analytical solution for true proportional navigation (TPN). The analytical solution to the TPN is then used to derive the time-to-go estimate that accounts for TPN acceleration.

Let $[E_1, E_2, E_3]$ be the basis vectors of the fixed reference frame. Two additional reference frames will also be employed: the LOS frame and the angular momentum frame. Let $[E_1^L, E_2^L, E_3^L]$ be the basis vectors of the LOS frame, with unit vector $e_1^L$ aligned with the LOS. Let $[e_1^h, e_2^h, e_3^h]$ be the basis vectors of the angular momentum frame, with unit vector $e_3^h$ aligned with the angular momentum vector. As will be shown below, the unit vector $e_1^h$ aligned with unit vector $e_1^L$. Further, the missile-to-target acceleration components expressed in the angular momentum frame can be solved analytically.

Figure 2:
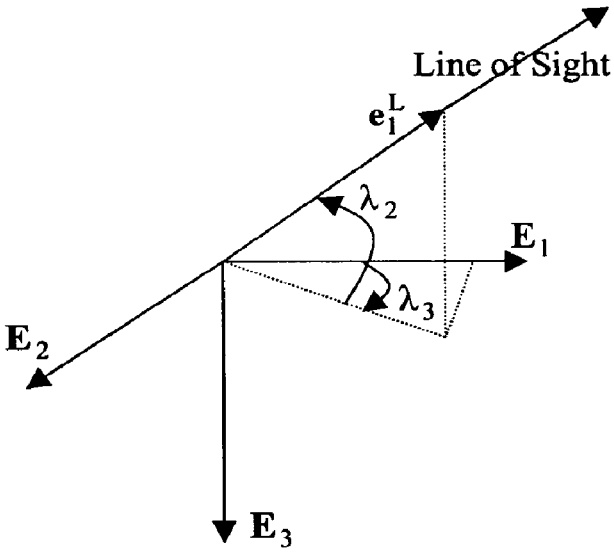
FIG. 2 shows a geometric relationship between a fixed reference frame and a LOS reference frame.

Let $\lambda_2$ and $\lambda_3$ be the LOS elevation and azimuth angles, respectively, with respect to the fixed reference frame. These LOS elevation and azimuth angles are illustrated in FIG. 2. The transformation between the LOS frame and the fixed reference frame is the matrix:

$$\begin{bmatrix} e_1^L \\ e_2^L \\ e_3^L \end{bmatrix} = \begin{bmatrix} \cos\lambda_2\cos\lambda_3 & \cos\lambda_2\sin\lambda_3 & -\sin\lambda_2 \\ -\sin\lambda_3 & \cos\lambda_3 & 0 \\ \sin\lambda_2\cos\lambda_3 & \sin\lambda_2\sin\lambda_3 & \cos\lambda_2 \end{bmatrix} \begin{bmatrix} E_1 \\ E_2 \\ E_3 \end{bmatrix}. \quad \text{Eq. 38}$$

The angular velocity $\omega$ and angular acceleration $\dot{\omega}$ associated with the LOS frame are:

$$\omega = \omega_1 e_1^L + \omega_2 e_2^L + \omega_3 e_3^L \quad \text{Eq. 39}$$

$$= -\dot{\lambda}_3\sin\lambda_2 e_1^L + \dot{\lambda}_2 e_2^L + \dot{\lambda}_3\cos\lambda_2 e_3^L, \quad \text{Eq. 40}$$

and $$\dot{\omega} = \dot{\omega}_1 e_1^L + \dot{\omega}_2 e_2^L + \dot{\omega}_3 e_3^L \quad \text{Eq. 41}$$

$$= \{-\ddot{\lambda}_3\sin\lambda_2 - \dot{\lambda}_2\dot{\lambda}_3\cos\lambda_2\}e_1^L + \{\ddot{\lambda}_2\}e_2^L + \{\ddot{\lambda}_3\cos\lambda_2 - \dot{\lambda}_2\dot{\lambda}_3\sin\lambda_2\}e_3^L. \quad \text{Eq. 42}$$

It follows that:

$$\dot{e}_1^L = \omega\ X e_1^L = \omega_3 e_2^L - \omega_2 e_3^L, \quad \text{Eq. 43}$$

$$\dot{e}_2^L = \omega\ X e_2^L = -\omega_3 e_1^L + \omega_1 e_3^L, \quad \text{Eq. 44}$$

-continued $$\dot{e}_3^L = \omega\ X e_3^L = \omega_2 e_1^L - \omega_1 e_2^L. \quad \text{Eq. 45}$$

The missile-to-target position r, velocity v, and acceleration a, respectively, are:

$$r = r e_1^L, \quad \text{Eq. 46}$$

$$v = \dot{r} = \dot{r} e_1^L + r\dot{e}_1^L = \dot{r} e_1^L + r\omega_3 e_2^L - r\omega_2 e_3^L, \quad \text{Eq. 47}$$

$$a = \dot{v} \quad \text{Eq. 48}$$

$$= \ddot{r} e_1^L + 2\dot{r}\omega \times e_1^L + r\dot{\omega} \times e_1^L + r\omega \times (\omega \times e_1^L)$$

$$= \{\ddot{r} - r(\omega_2^2 + \omega_3^2)\}e_1^L + \{2\dot{r}\omega_3 + r\dot{\omega}_3 + r\omega_1\omega_2\}e_2^L - \{2\dot{r}\omega_2 + r\dot{\omega}_2 - r\omega_1\omega_3\}e_3^L. \quad \text{Eq. 49}$$

The angular momentum h, using Eqs 46 and 47, is defined as:

$$h = r \times \dot{r} = r^2\{\omega_2 e_2^L + \omega_3 e_3^L\}. \quad \text{Eq. 50}$$

Rewriting Eq. 50 yields:

$$h = h e_3^h, \quad \text{Eq. 51}$$

where:

$$h = r^2\sqrt{\omega_2^2 + \omega_3^2} = r^2\overline{\omega}, \text{ and} \quad \text{Eq. 52}$$

$$e_3^h = \frac{\omega_2 e_2^L + \omega_3 e_3^L}{\sqrt{\omega_2^2 + \omega_3^2}} = \overline{\omega}_2 e_2^L + \overline{\omega}_3 e_3^L, \quad \text{Eq. 53}$$

based upon:

$$\overline{\omega}_2 = \frac{\omega_2}{\overline{\omega}}, \quad \text{Eq. 54}$$

$$\overline{\omega}_3 = \frac{\omega_3}{\overline{\omega}}, \text{ and} \quad \text{Eq. 55}$$

$$\overline{\omega} = \sqrt{\omega_2^2 + \omega_3^2}. \quad \text{Eq. 56}$$

From Eq. 53, it is clear that $e_3^h$ is perpendicular to $e_1^L$. By aligning $e_1^h$ with $e_1^L$, i.e.:

$$e_1^h = e_1^L, \quad \text{Eq. 57}$$

then:

$$e_2^h = e_3^h \times e_1^h = \frac{\omega_3 e_2^L - \omega_2 e_3^L}{\sqrt{\omega_2^2 + \omega_3^2}} = \overline{\omega}_3 e_2^L - \overline{\omega}_2 e_3^L. \quad \text{Eq. 58}$$

The transformation matrices between the LOS frame [$e_1^L$, $e_2^L$, $e_3^L$] and the angular momentum frame [$e_1^h$, $e_2^h$, $e_3^h$] are:

$$\begin{bmatrix} e_1^h \\ e_2^h \\ e_3^h \end{bmatrix} = \begin{bmatrix} 1 & 0 & 0 \\ 0 & \overline{\omega}_3 & -\overline{\omega}_2 \\ 0 & \overline{\omega}_2 & \overline{\omega}_3 \end{bmatrix} \begin{bmatrix} e_1^L \\ e_2^L \\ e_3^L \end{bmatrix}, \text{ and} \quad \text{Eq. 59}$$

$$\begin{bmatrix} e_1^L \\ e_2^L \\ e_3^L \end{bmatrix} = \begin{bmatrix} 1 & 0 & 0 \\ 0 & \overline{\omega}_3 & \overline{\omega}_2 \\ 0 & -\overline{\omega}_2 & \overline{\omega}_3 \end{bmatrix} \begin{bmatrix} e_1^h \\ e_2^h \\ e_3^h \end{bmatrix}. \quad \text{Eq. 60}$$

These transformation matrices are orthogonal if $\omega_2^2+\omega_3^2\neq 0$.

The missile-to-target acceleration a can be expressed as:

$$a = a_1^L e_1^L + a_2^L e_2^L + a_3^L e_3^L = a_1^h e_1^h + a_2^h e_2^h + a_3^h e_3^h. \quad \text{Eq. 61}$$

By comparing Eqs. 49 and 61 and substituting with Eqs. 52, 53, 59, and 60, the missile-to-target acceleration components are:

$$a_1^L = \{\ddot{r} - r(\omega_2^2 + \omega_3^2)\} = \left\{\ddot{r} - \frac{h^2}{r^3}\right\}, \quad \text{Eq. 62}$$

$$a_2^L = 2\dot{r}\omega_3 + r\dot{\omega}_3 + r\omega_1\omega_2, \quad \text{Eq. 63}$$

$$a_3^L = -2\dot{r}\omega_2 - r\dot{\omega}_2 + r\omega_1\omega_3, \quad \text{Eq. 64}$$

$$a_1^h = a_1^L = \left\{\ddot{r} - \frac{h^2}{r^3}\right\}, \quad \text{Eq. 65}$$

$$\begin{aligned} a_2^h &= \overline{\omega}_3 a_2^L - \overline{\omega}_2 a_3^L \\ &= 2\dot{r}(\overline{\omega}_2\omega_2 + \overline{\omega}_3\omega_3) + r(\overline{\omega}_2\dot{\omega}_2 + \overline{\omega}_3\dot{\omega}_3), \text{ and} \end{aligned} \quad \text{Eq. 66}$$

$$a_3^h = \overline{\omega}_2 a_2^L + \overline{\omega}_3 a_3^L = r\{\overline{\omega}_1(\omega_2^2 + \omega_3^2) + (\overline{\omega}_2\dot{\omega}_3 + \overline{\omega}_3\dot{\omega}_2)\}. \quad \text{Eq. 67}$$

The resulting angular momentum rate $\dot{h}$ is obtained by differentiating Eqs. 50 or 51:

$$\begin{aligned} \dot{h} &= h e_3^h + h\dot{e}_3^h \\ &= r \times \ddot{r} \end{aligned} \quad \text{Eq. 68}$$

$$= -r a_3^L e_2^L + r a_2^L e_3^L. \quad \text{Eq. 69}$$

With the help of transformation matrix Eq. 60, Eq. 69 becomes:

$$\begin{aligned} \dot{h} &= -r a_3^L(\overline{\omega}_3 e_2^h + \overline{\omega}_2 e_3^h) + r a_2^L(-\overline{\omega}_2 e_2^h + \overline{\omega}_3 e_3^h) \\ &= -r(\overline{\omega}_2 a_2^L + \overline{\omega}_3 a_3^L)e_2^h + r(\overline{\omega}_3 a_2^L + \overline{\omega}_2 a_3^L)e_3^h. \end{aligned} \quad \text{Eq. 70, Eq. 71}$$

By comparing Eqs. 68 and 71, and using Eqs. 63, 64, and 67, the following equations are obtained:

$$\begin{aligned} \dot{h} &= r(\overline{\omega}_3 a_2^L + \overline{\omega}_2 a_3^L) \\ &= r\{2\dot{r}(\overline{\omega}_2\omega_2 + \overline{\omega}_3\omega_3) + r(\overline{\omega}_2\dot{\omega}_2 + \overline{\omega}_3\dot{\omega}_3)\}, \text{ and} \end{aligned} \quad \text{Eq. 72}$$

-continued $$\begin{aligned} \dot{e}_3^h &= -\frac{r}{h}(\overline{\omega}_2 a_2^L + \overline{\omega}_3 a_3^L)e_2^h \\ &= -\frac{r}{h} a_3^h e_2^h \end{aligned} \quad \text{Eq. 73}$$

$$= -\frac{r^2}{h}\{\overline{\omega}_1(\omega_2^2 + \omega_3^2) + (\overline{\omega}_2\dot{\omega}_3 + \overline{\omega}_3\dot{\omega}_2)\}e_2^h. \quad \text{Eq. 74}$$

Substituting Eqs. 72 and 74 into Eq. 68 yields:

$$\dot{h} = -r^2\{\overline{\omega}_1(\omega_2^2+\omega_3^2)+(\overline{\omega}_2\dot{\omega}_3-\overline{\omega}_3\dot{\omega}_2)\}e_2^h + r\{2\dot{r}(\overline{\omega}_2\omega_2+\overline{\omega}_3\omega_3)+r(\overline{\omega}_2\dot{\omega}_2+\overline{\omega}_3\dot{\omega}_3)\}e_3^h. \quad \text{Eq. 75}$$

By comparing Eqs. 66 and 72, one obtains:

$$a_2^h = \overline{\omega}_3 a_2^L - \overline{\omega}_2 a_3^L = \frac{\dot{h}}{r}. \quad \text{Eq. 76}$$

By substituting Eqs. 65 and 76 into Eq. 61, the missile-to-target acceleration a becomes:

$$a = \left\{\ddot{r} - \frac{h^2}{r^3}\right\}e_1^h + \frac{\dot{h}}{r}e_2^h + a_3^h e_3^h. \quad \text{Eq. 77}$$

The missile command acceleration for the TPN is:

$$a_M = N\dot{r}e_l^L \times \Omega, \quad \text{Eq. 78}$$

where N is the proportional navigation constant and:

$$\Omega = \frac{r \times \dot{r}}{r^2} = \frac{h}{r^2} = \omega_2 e_2^L + \omega_3 e_3^L. \quad \text{Eq. 79}$$

Ω is the angular velocity of the LOS. With the help of Eqs. 51-53, 59, 60, and 79, Eq. 78 becomes:

$$\begin{aligned} a_M &= \frac{N\dot{r}e_1^L \times h}{r^2} \\ &= \frac{N\dot{r}h e_1^h \times e_3^h}{r^2} \\ &= -\frac{N\dot{r}h e_2^h}{r^2} \\ &= -N\dot{r}\overline{\omega}e_2^h \end{aligned} \quad \text{Eq. 80}$$

$$= N\dot{r}(-\omega_3 e_2^L + \omega_2 e_3^L). \quad \text{Eq. 81}$$

By assuming a non-accelerating target, the missile-to-target acceleration a is:

$$a = \left\{\ddot{r} - \frac{h^2}{r^3}\right\}e_1^h + \frac{\dot{h}}{r}e_2^h + a_3^h e_3^h = \frac{N\dot{r}h}{r^2}e_2^h. \quad \text{Eq. 82}$$

Eq. 82 leads to the following coupled nonlinear differential equations:

$$\ddot{r} - \frac{h^2}{r^3} = 0, \quad \text{Eq. 83}$$

-continued $$\dot{h} = \frac{Nh\dot{r}}{r}, \text{ and} \quad \text{Eq. 84}$$

$$a_3^h = 0. \quad \text{Eq. 85}$$

Assuming the solution for h is of the form:

$$h=c_1r^K, \quad \text{Eq. 86}$$

where $c_1$ is an unknown to be determined. Differentiating Eq. 86 yields:

$$\dot{h} = c_1Kr^{K-1}\dot{r} = \frac{Kh\dot{r}}{r}. \quad \text{Eq. 87}$$

By comparing Eqs. 84 and 87, it is apparent that K=N. Therefore:

$$h=c_1r^N. \quad \text{Eq. 88}$$

Rewriting Eq. 83 using Eq. 88 yields:

$$\ddot{r}-c_1^2r^{2N-3}=0. \quad \text{Eq. 89}$$

Assuming the solution for $\dot{r}$ is of the form:

$$\dot{r}^2=c_2+c_3r^M, \quad \text{Eq. 90}$$

where $c_2$, $c_3$, and M are the unknowns to be determined. Differentiating Eq. 90 yields:

$$2\dot{r}\ddot{r}=c_3Mr^{M-1}\dot{r}. \quad \text{Eq. 91}$$

Substituting Eq. 89 into Eq. 91 yields:

$$2c_1^2r^{2N-3}=c_3Mr^{M-1}\dot{r}. \quad \text{Eq. 92}$$

From Eq. 92, the unknowns are determined to be:

$$M = 2N - 2, \text{ and} \quad \text{Eq. 93}$$

$$c_3 = \frac{2c_1^2}{M} = \frac{c_1^2}{N-1}. \quad \text{Eq. 94}$$

Rewriting Eq. 90 in view of Eqs. 93 and 94 shows:

$$\dot{r}^2 = c_2 + \frac{c_1^2}{N-1}r^{2N-2}. \quad \text{Eq. 95}$$

By defining $r_0$, $\dot{r}_0$, $h_0$, and $\overline{\omega}_0$ to be the initial values of r, $\dot{r}$, h, and $\overline{\omega}$, respectively, Eq. 88 can be rewritten as:

$$c_1 = \frac{h_0}{r_0^N}. \quad \text{Eq. 96}$$

By applying Eq. 96 and the above initial values to Eq. 95 and solving for $c_2$ shows:

$$c_2 = \dot{r}_0^2 - \frac{h_0^2/r_0^{2N}}{N-1}r_0^{2N-2} = \dot{r}_0^2 - \frac{h_0^2/r_0^2}{N-1} \quad \text{Eq. 97}$$

Substituting Eq. 96 into Eqs. 88 and 95, the solutions for the angular momentum h and the range rate $\dot{r}$ are thus:

$$h = h_0\left(\frac{r}{r_0}\right)^N, \text{ and} \quad \text{Eq. 98}$$

$$\dot{r} = -\sqrt{\dot{r}_0^2 - \frac{h_0^2/r_0^2}{N-1} + \frac{h_0^2/r_0^{2N}}{N-1}r^{2N-2}}. \quad \text{Eq. 99}$$

By substituting Eq. 98 into Eq. 79, the magnitude of the LOS angular velocity Ω is:

$$\Omega = \frac{h}{r^2} = \frac{h_0}{r_0^2}\left(\frac{r}{r_0}\right)^{N-2}. \quad \text{Eq. 100}$$

To maintain finite acceleration, N must thus be greater than 2.

For Eq. 99 to yield a real solution for the range rate $\dot{r}$, the following condition must be satisfied for a successful interception:

$$\dot{r}_0^2 - \frac{h_0^2/r_0^2}{N-1} > 0. \quad \text{Eq. 101}$$

Using Eq. 52, Eq. 101 becomes:

$$\frac{|\dot{r}_0|}{r_0\overline{\omega}_0} > \sqrt{\frac{1}{N-1}}. \quad \text{Eq. 102}$$

Returning to Eq. 47 and using Eq. 52, the magnitude of the missile-to-target velocity v is:

$$v = \sqrt{\dot{r}^2 + r^2(\omega_2^2 + \omega_3^2)} = \sqrt{\dot{r}^2 + \frac{h^2}{r^2}}. \quad \text{Eq. 103}$$

Similarly, the magnitudes of the angular momentum h and the range rate $\dot{r}$ from Eq. 50 and FIG. 1 are:

$$h=\|r\times\dot{r}\|=rv\sin\alpha, \text{ and} \quad \text{Eq. 104}$$

$$\dot{r}=v\cos\alpha. \quad \text{Eq. 105}$$

The following dimensionless parameters are defined as the normalized range $\bar{r}$, the normalized angular momentum $\bar{h}$, and the normalized time $\bar{t}$:

$$\bar{r} = \frac{r}{r_0}, \quad \text{Eq. 106}$$

$$\bar{h} = \frac{h}{r_0v_0}, \text{ and} \quad \text{Eq. 107}$$

$$\bar{t} = \frac{t}{r_0/v_0}, \quad \text{Eq. 108}$$

where $v_0$ and $t_0$ are initial values of v and t, respectively. Using Eqs. 106-108, Eqs. 98 and 99 simplify as:

$$\bar{h} = \bar{h}_0\bar{r}^N, \quad \text{Eq. 109}$$

-continued $$\frac{d\bar{r}}{d\bar{t}} = -\sqrt{\frac{\dot{r}_0^2}{v_0^2} + \frac{\bar{h}_0^2}{N-1}(\bar{r}^{2N-2} - 1)}. \quad \text{Eq. 110}$$

Using Eq. 110, the normalized time $\bar{t}$ for the normalized range $\bar{r}$ is:

$$\bar{t} = -\int_1^{\bar{r}} \frac{d\bar{r}}{\sqrt{\frac{\dot{r}_0^2}{v_0^2} + \frac{\bar{h}_0^2}{N-1}(\bar{r}^{2N-2} - 1)}}. \quad \text{Eq. 111}$$

From Eqs. 104, 105, and 107, it is clear that:

$$\frac{\dot{r}_0}{v_0} = \cos\alpha_0, \text{ and} \quad \text{Eq. 112}$$

$$\bar{h}_0 = \sin\alpha_0, \quad \text{Eq. 113}$$

where $\alpha_0$ is the initial value of $\alpha$. Eq. 111 therefore becomes:

$$\bar{t} = -\sec\alpha_0 \int_1^{\bar{r}} \frac{d\bar{r}}{\sqrt{1 + \frac{\tan^2\alpha_0}{N-1}(\bar{r}^{2N-2} - 1)}}. \quad \text{Eq. 114}$$

The normalized time-to-go $\bar{\tau}$ is:

$$\bar{\tau} = \sec\alpha_0 \int_0^1 \frac{d\bar{r}}{\sqrt{1 + \frac{\tan^2\alpha_0}{N-1}(\bar{r}^{2N-2} - 1)}}. \quad \text{Eq. 115}$$

If $\alpha_0$=0, then:

$$\bar{\tau}=1, \text{ and} \quad \text{Eq. 116}$$

$$\tau=r_0/v_0. \quad \text{Eq. 117}$$

A real solution to Eq. 115 imposes the following requirement:

$$\alpha_0 < \tan^{-1}\sqrt{\left(\frac{N-1}{1-\bar{r}^{2N-2}}\right)}. \quad \text{Eq. 118}$$

As the normalized range $\bar{r}\rightarrow 0$, then Eq. 118 simplifies to:

$$\alpha_0<\tan^{-1}\sqrt{N-1}. \quad \text{Eq. 119}$$

The normalized missile acceleration command $\bar{a}_M$ is defined as:

$$\bar{a}_M = \frac{a_M}{v_0^2/r_0} = -\frac{N\dot{r}h}{r^2 v_0^2/r_0} = -\frac{N\bar{h}}{\bar{r}^2}\frac{d\bar{r}}{d\bar{t}} = N\bar{h}_0\bar{r}^{N-2}\frac{d\bar{r}}{d\bar{t}} \quad \text{Eq. 120}$$

$$= N\bar{h}_0\bar{r}^{N-2}\sqrt{\frac{\dot{r}_0^2}{v_0^2} + \frac{\bar{h}_0^2}{N-1}(\bar{r}^{2N-2} - 1)} \quad \text{Eq. 121}$$

$$= \frac{\sin 2\alpha_0 N\bar{r}^{N-2}}{2}\sqrt{1 + \frac{\tan^2\alpha_0}{N-1}(\bar{r}^{2N-2} - 1)}, \quad \text{Eq. 122}$$

when Eqs. 106-110 and 113 are used.

The above results will now be used to compute an estimated time-to-go that accounts for the missile acceleration due to TPN guidance. Turning to Eqs. 115 and 117, the time-to-go $\tau$ is:

$$\tau = \frac{r_0\sec\alpha_0}{v_0}\int_0^1 \frac{d\bar{r}}{\sqrt{1 + \frac{\tan^2\alpha_0}{N-1}(\bar{r}^{2N-2} - 1)}}. \quad \text{Eq. 123}$$

Note that for a given TPN constant N, the estimated time-to-go is dependent on the initial relative range and speed and the angle between the initial relative position and velocity vectors $\alpha$. As the time-to-go is a function of both the TPN constant N and the angle $\alpha$, Eq. 123 becomes:

$$\tau = \frac{r_0 f(N, \alpha_0)}{v_0}, \quad \text{Eq. 124}$$

where:

$$f(N, \alpha_0) = \sec\alpha_0 \int_0^1 \frac{d\bar{r}}{\sqrt{1 + \frac{\tan^2\alpha_0}{N-1}(\bar{r}^{2N-2} - 1)}}. \quad \text{Eq. 125}$$

Figure 3:
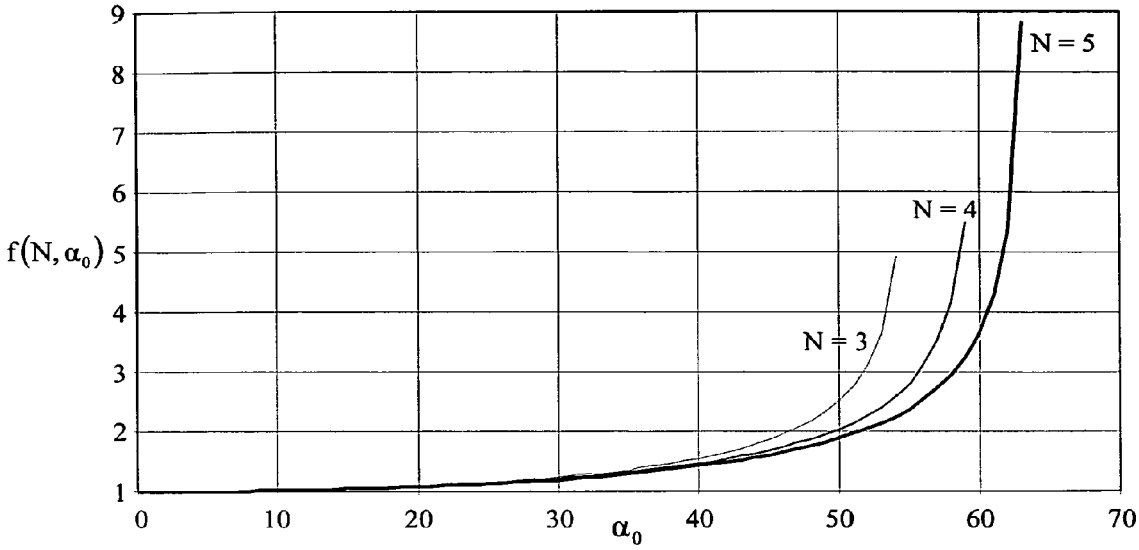
FIG. 3 is a plot of a guidance scaling factor as a function of initial angle $\alpha_0$ and proportional navigation gain N.

The function $f(N,\alpha_0)$ in Eq. 125 is the TPN guidance scaling factor for the time-to-go calculation that accounts for the missile acceleration due to TPN acceleration commands. Plots of $f(N,\alpha_0)$ vs. $\alpha_0$ for N=3, 4, and 5 are shown in FIG. 3.

The following equation is a good approximation of Eq. 124 for N=3, 4, and 5.

$$\tau = \frac{(r_0\{1 + p_1(N)\alpha_0 + p_2(N)\alpha_0^2 + p_3(N)\alpha_0^3 + p_4(N)\alpha_0^4 + p_5(N)\alpha_0^5\})}{(v_0)}, \quad \text{Eq. 126}$$

where $p_i(N)$, $p_2(N)$, $p_3(N)$, $p_4(N)$, and $p_5(N)$ are polynomials of the form:

$$p_1(N)=2.5285-1.05197N+0.1115N^2, \quad \text{Eq. 127A}$$

$$p_2(N)=-31.6485+13.4178N-1.4236N^2, \quad \text{Eq. 127B}$$

$$p_3(N)=134.5987-55.7204N+5.8922N^2, \quad \text{Eq. 127C}$$

$$p_4(N)=-220.3862+91.0563N-9.6156N^2, \text{ and} \quad \text{Eq. 127D}$$

$$p_5(N)=127.9458-52.3959N+5.5147N^2. \quad \text{Eq. 127E}$$

Eq. 125 can be rewritten as:

$$f(N, \alpha_0) = \sec\alpha_0\left\{1 - \frac{\tan^2\alpha_0}{N-1}\right\}^{-\frac{1}{2}}\int_0^1\left\{1 + \frac{\tan^2\alpha_0\bar{r}^{2N-2}}{(N-1) - \tan^2\alpha_0}\right\}^{-\frac{1}{2}} d\bar{r}. \quad \text{Eq. 128}$$

When the initial angle $\alpha_0$ is small, i.e.:

$$\frac{\tan^2\alpha_0}{(N-1)-\tan^2\alpha_0} < 1, \quad \text{Eq. 129}$$

Eq. 129 may be approximated by:

$$\tan^2\alpha_0 < \frac{N-1}{2}. \quad \text{Eq. 130}$$

This leads to the further approximation of Eq. 128 as:

$$f(N, \alpha_0) = \sec\alpha_0\left\{1-\frac{\tan^2\alpha_0}{N-1}\right\}^{-\frac{1}{2}}\int_0^1\left\{1-\frac{\tan^2\alpha_0\bar{r}^{2N-2}}{2[(N-1)-\tan^2\alpha_0]}\right\}d\bar{r} \quad \text{Eq. 131}$$

$$= \sec\alpha_0\left\{1-\frac{\tan^2\alpha_0}{N-1}\right\}^{-\frac{1}{2}}\left\{1-\frac{\tan^2\alpha_0}{2(2N-1)[(N-1)-\tan^2\alpha_0]}\right\}. \quad \text{Eq. 132}$$

The time-to-go $\tau$ under these small initial angle $\alpha_0$ conditions is approximately:

$$\tau = \frac{r_0\sec\alpha_0\left\{1-\frac{\tan^2\alpha_0}{2(2N-1)[(N-1)-\tan^2\alpha_0]}\right\}}{v_0\sqrt{\left\{1-\frac{\tan^2\alpha_0}{N-1}\right\}}}. \quad \text{Eq. 133}$$

Numerical Examples

Figure 4:
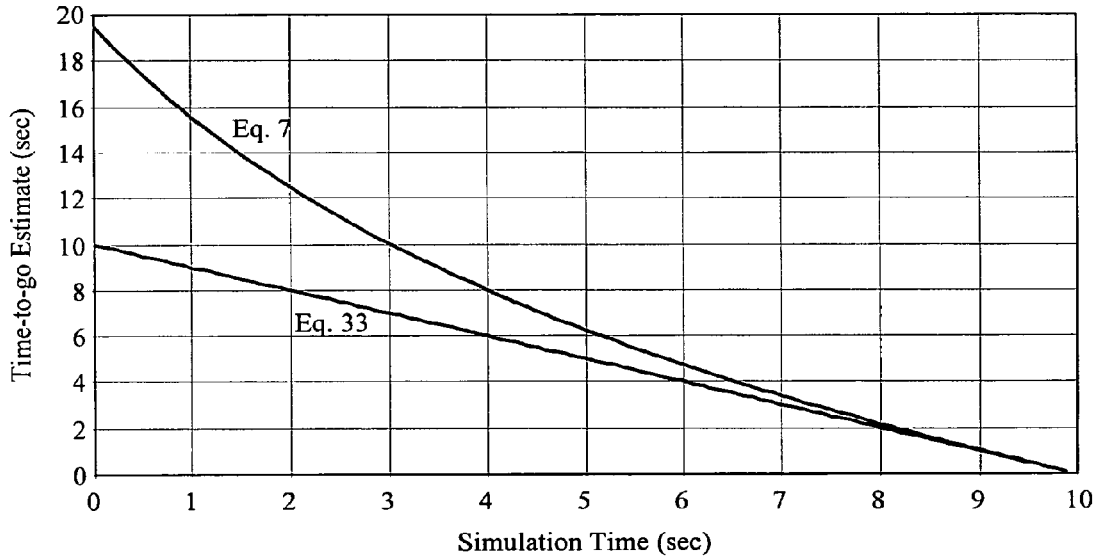
FIG. 4 is a plot of the estimated time-to-go $\tau$ for different time-to-go equations using a first set of initial conditions.

The results of several numerical examples for time-to-go calculations will now be discussed. In the first example, r=(5000, 5000, 5000), v=(−300, −250, −200), and a=(−40, −50, −60). The results are shown in FIG. 4. It is clear that Eq. 33 yields the exact solution while Eq. 7 returns a large error initially, though the time-to-go error is reduced as the simulation time draws closer to intercept. If a missile, which carries a warhead that must detonate when the missile is close to the target, used Eq. 7 to arm itself, the warhead would uselessly explode far beyond the target as Eq. 7's time-to-go is almost twice the actual time-to-go.

The second numerical example is a TPN simulation, with a proportional navigation gain N=3. The initial missile and target conditions are:

| | Missile | Target |
|---|---|---|
| Initial Position | (0, 0, 0) | (1000, 1000, 500) |
| Initial Velocity | (100, 0, 0) | (−10, −5, −5) |
| Initial Acceleration | (0, 0, 0) | (0, 0, 0) |

Figure 5:
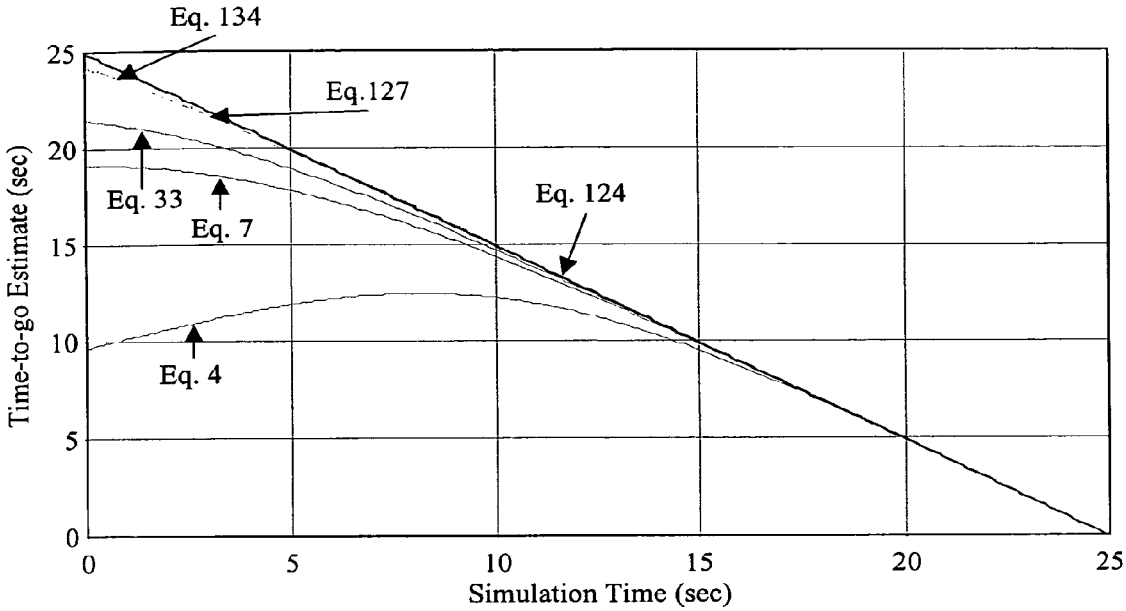
FIG. 5 is a plot of the estimated time-to-go $\tau$ for different time-to-go equations using a second set of initial conditions.

The results for several time-to-go approximations are plotted in FIG. 5. It is clear that Eq. 123 provides substantially the exact time-to-go. Eq. 126 is based on curve fitting of Eq. 123, and the result is almost identical to Eq. 123. Eq. 133 is based on an approximation (Eq. 130) of the integral in order to obtain the closed-form solution. The result using Eq. 133 is good even when the initial angle $\alpha_0$ between the relative velocity and the LOS used in this example is 44.7°. The acceleration used in Eq. 33 is based on half of the initial missile acceleration due to TPN guidance as the acceleration at intercept is assumed to be zero. In this numerical example, Eqs. 7 and 9 will produce the same results because the acceleration is perpendicular to the LOS, thus causing the mean acceleration along the LOS to be zero. Eq. 4 grossly underestimates the time-to-go.

Figure 6:
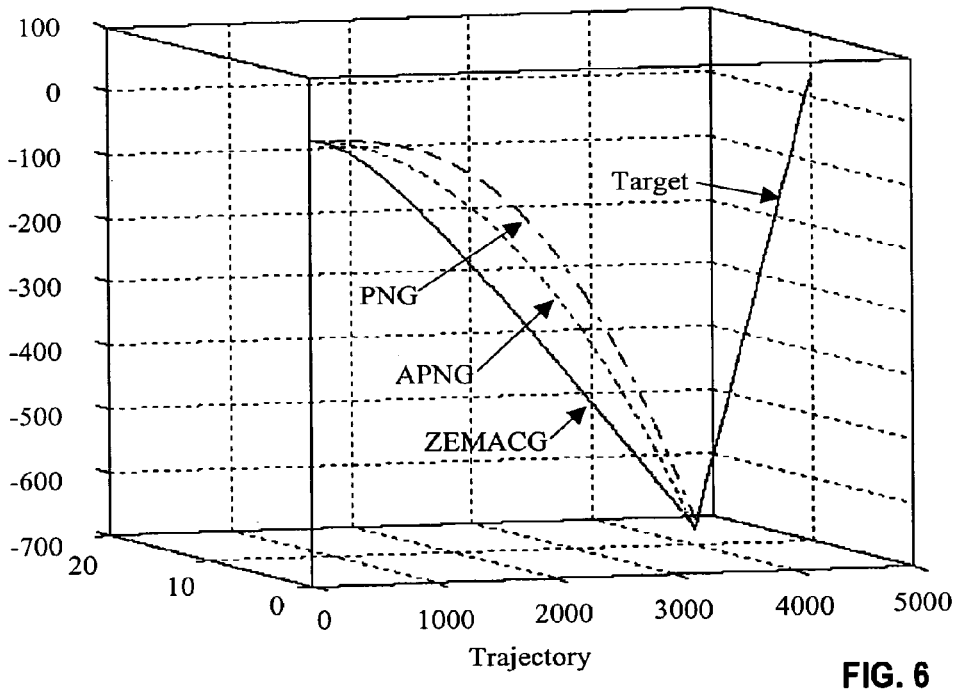
FIG. 6 illustrates the trajectories of missiles using three different guidance methods to intercept a target.

In the third numerical simulation, the trajectories of three missiles and a target are shown in FIG. 6. For this simulation, the three missiles use proportional navigation (PNG), augmented PNG (APNG), and Eq. 34 in conjunction with Eqs. 30 or 33, respectively. The combined use of Eqs. 34 and 30 or 33 will be termed zero-effort-miss with acceleration compensation guidance (ZEMACG). The ZEMACG missile clearly provides the most direct interception trajectory, with the trajectory being nearly linear for most of the flight. The advantage of ZEMACG is that it accounts for the actual target acceleration properly and steers the missile toward the proper interception path as early as possible.

Figure 7:
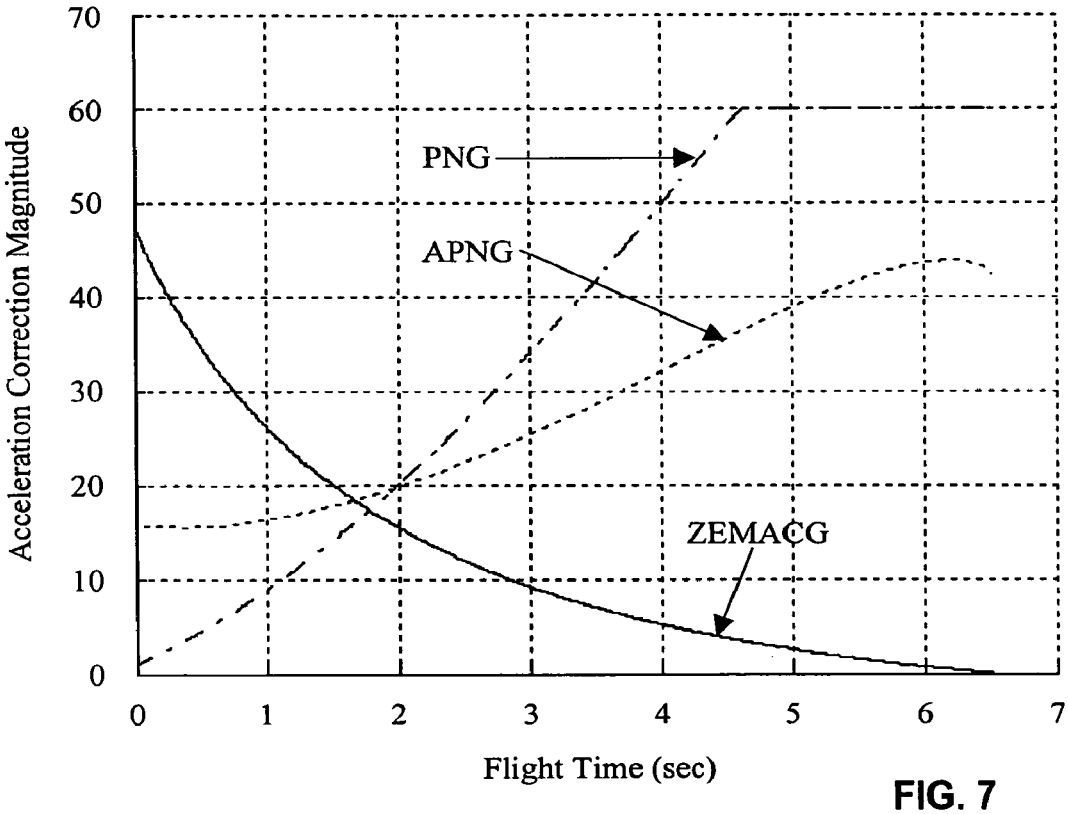
FIG. 7 illustrates the magnitude of the acceleration command using three different guidance methods.

FIG. 7 illustrates the magnitude of the acceleration correction for each of the three missiles illustrated in FIG. 6. The PNG missile initially has no acceleration correction, but climbs rapidly and continues to have its trajectory corrected until the moment of interception. The APNG missile has some initial acceleration correction that increases during the course of the flight, but does not require as large an acceleration correction as the PNG missile. Lastly, the ZEMACG missile shows the greatest initial acceleration correction, but the magnitude rapidly decreases with virtually no acceleration correction required shortly before interception. Because of the higher acceleration required near the end of a PNG missile flight, it might not have enough acceleration to intercept the target. This problem may be exacerbated because the acceleration of the PNG missile can become saturated. The net result is a greater miss distance. This problem is greatest at high altitudes where the air is thin and missile maneuverability is low. Under these circumstances, it is desirable to make the acceleration corrections early, at low altitude, while the missile has high maneuverability. A ZEMACG missile, with its greater acceleration correction early in flight, thus has the advantage.

Figure 8:
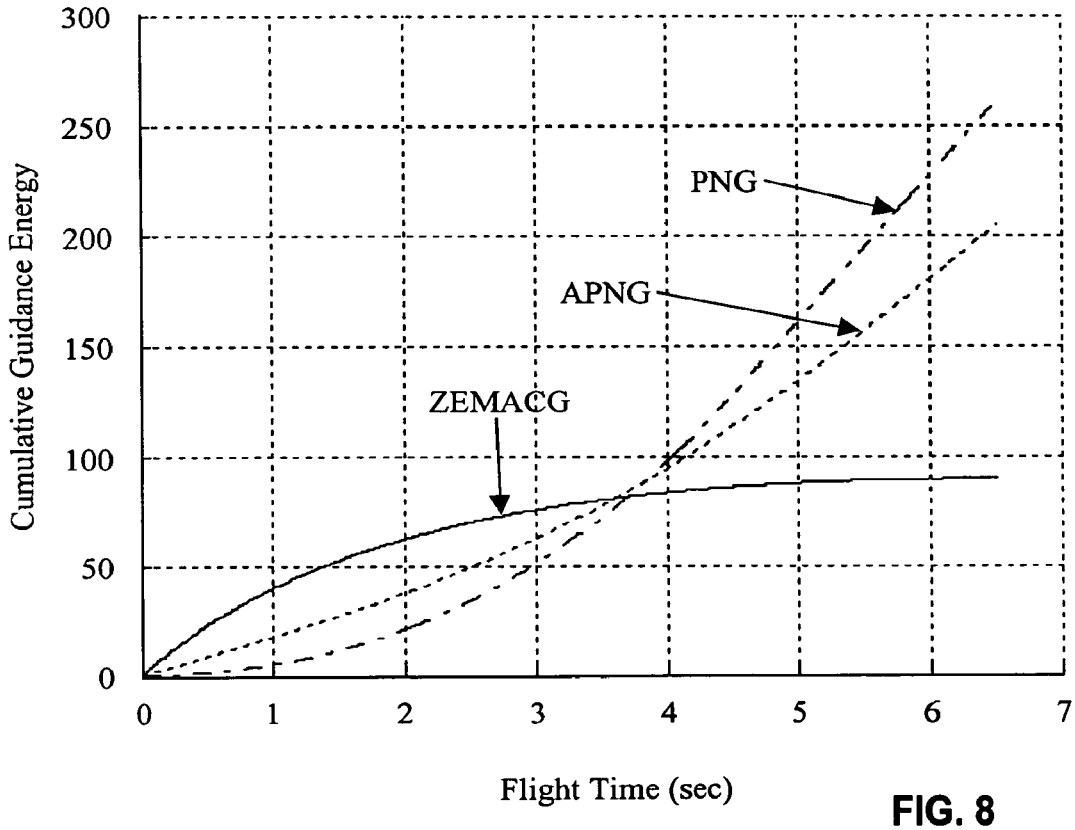
FIG. 8 illustrates the cumulative amount of energy required to implement the acceleration commands of three different guidance methods.

FIG. 8 illustrates the cumulative use of guidance energy due to acceleration correction as a function of flight time. As shown in FIG. 8, the PNG missile uses approximately three times as much guidance energy as does the ZEMACG missile, while the APNG missile uses more than twice as much. An additional advantage of the ZEMACG missile is that it requires less energy and thus less weight. The result is that a lighter missile is feasible. Alternatively, if the same weight is retained, a faster and/or more lethal missile is possible.

Figure 9:
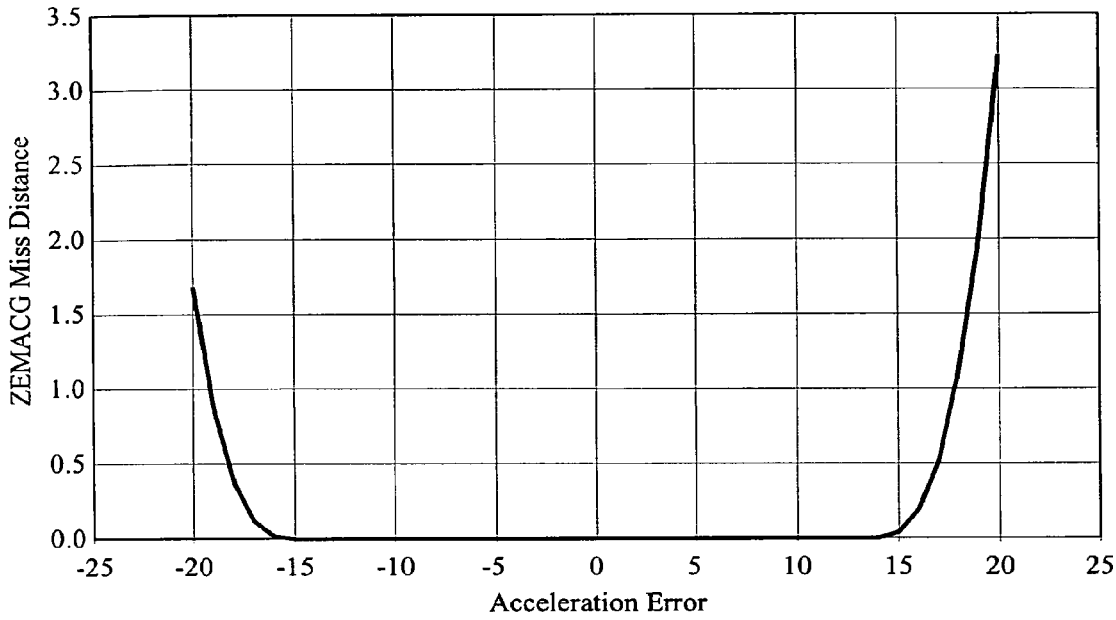
FIG. 9 illustrates the miss distance for one embodiment of the present invention as a function of target acceleration error.

FIG. 9 shows the miss distance for a ZEMACG missile as a function of acceleration error. This simulation shows the ZEMACG missile will intercept the target even when the acceleration error is as large as ±15 m/sec$^2$. The ZEMACG missile, even with target acceleration errors, still outperforms the PNG missile.

Figure 10:
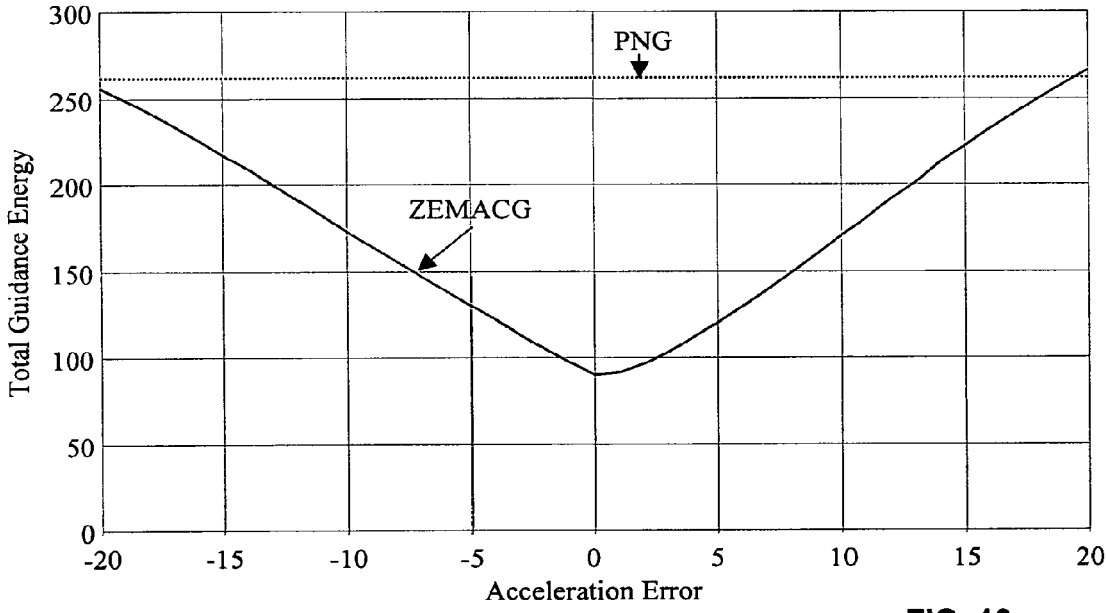
FIG. 10 illustrates the cumulative amount of energy required to implement the acceleration commands of two different guidance methods as a function of target acceleration error.

FIG. 10 illustrates the total use of guidance energy due to acceleration correction as a function of acceleration error. The energy used by the ZEMACG missile is a function of acceleration error with greater error leading to greater energy demands. An acceleration error of ±20 m/sec$^2$ is required before the ZEMACG missile requires as much energy as the PNG missile.

Implementation

Depending upon the time-to-go estimation implemented, various input values are required. In the simplest case, Eq. 33 requires inputs of the missile-to-target vector r, the missile-to-target velocity v, and the missile-to-target acceleration a.

Even the most computationally complex time-to-go $\tau$ estimation scheme based on Eq. 123 requires the same inputs of r, v, and a.

Figure 11:
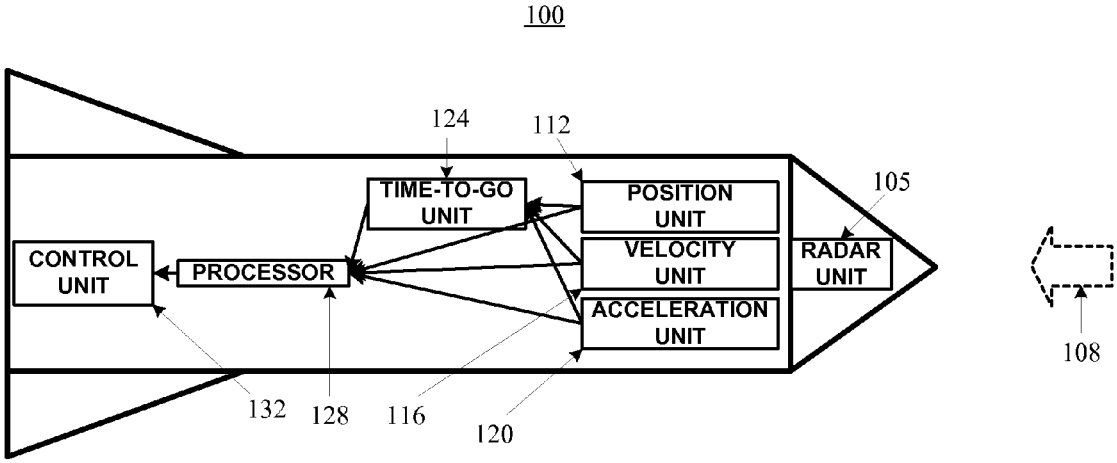
FIG. 11 illustrates a first missile system according to the present invention.

These three inputs can come from a variety of sources. In a "fire and forget" missile system 100, as shown in FIG. 11, the three inputs may be determined based upon an on-board radar 104. A position unit 112 that determines the missile-to-target vector r processes a radar return signal 108. A velocity unit 116 that determines the missile-to-target velocity v also processes the radar return signal 108. Lastly, the radar return signal 108 is processed by an acceleration unit 120 that determines the missile-to-target acceleration a. A time-to-go unit 124 then determines the time-to-go $\tau$ based upon the three inputs r, v, and a. For guidance purposes, a processor 128 calculates an acceleration command A based upon Eq. 34 using the four inputs r, v, a, and $\tau$. It should be noted that while the position unit 112, the velocity unit 116, the acceleration unit 120, the time-to-go unit 124, and the processor 128 are illustrated as separate elements, each could be implemented in software using a single processor. The time-to-go $\tau$ and the acceleration command A are iteratively computed during the course of the intercept trajectory, preferably on a periodic basis. The acceleration command A from the processor 128 is then fed to a control unit 132 that controls the trajectory of the missile system 100. While this example uses an on-board radar 104, use of an on-board optical system is also envisioned.

Figure 12:
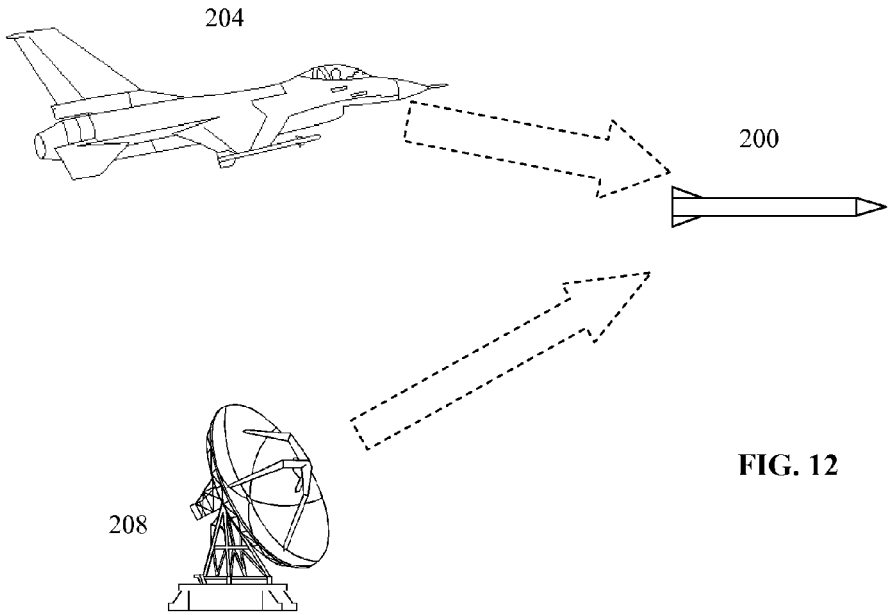
FIG. 12 illustrates a second missile system according to the present invention.

An alternative way to implement a time-to-go estimation scheme is to receive information from an external source as shown in FIG. 12. The missile system 200 in this case receives updated r, v, and a values from the external source, preferably on a periodic basis, and calculates revised time-to-go $\tau$ and acceleration command A values. The external source may be an aircraft 204 that launched the missile system 200. The external source may alternatively be a ground-based tracking system 208. The missile system 200 may alternatively be ground launched rather than air launched.

Yet another alternative way to implement a time-to-go estimation scheme is to store at least a portion of the information in a memory. This method applies when the velocity and/or acceleration profiles for both the missile system and the target are known a priori. The initial values of r, v, and a would still need to be provided to the missile system.

The control unit 132 in missile system 100 may include one or more control elements. These possible control elements include, but are not limited to, axial thrusters, radial thrusters, and control surfaces such as fins or canards.

While the above description disclosed application of the time-to-go method to a missile system traveling in air, it is equally applicable to other intercepting vehicles. In particular, the disclosed time-to-go method can also be applied to torpedoes traveling in water.

Accident Avoidance

The embodiments described above relate to the intentional interception of a target by a vehicle. In many situations, just the reverse is desired. As an example, an accident avoidance system may be implemented to guide a vehicle away from another vehicle or obstacle. By including velocity and actual or real time acceleration effects in an acceleration command, an automobile can more accurately avoid moving vehicles/obstacles, such as an abrupt lane change by another automobile. This is in contrast to most current automobile systems that typically warn only of fixed vehicles/obstacles, especially when reversing into a parking spot. After estimating the time-to-go from either Eq. 30 or Eq. 33, Eq. 10 can then be used to determine the closest distance between the two vehicles if the vehicles continue at their current velocities and accelerations. An accident avoidance system according to the present invention would thus provide for earlier detection of potential accidents. The sooner a potential accident is detected, the more time a driver or system has to react and the less acceleration will be needed to avoid the accident. Such an accident avoidance system could generate an acceleration command A' that is the complete opposite of the acceleration command A generated by the system in which an interception is intended. As such an acceleration command A' might be more abrupt than needed to avoid an accident, the accident avoidance system would preferably generate an acceleration command A" only of sufficient magnitude to avoid the accident. The magnitude of this acceleration command A" could also be determined by a minimum margin required to avoid an accident by, for example, a predetermined number of feet. For purposes of an accident avoidance system, an offset vector $\psi$ is added to the original acceleration command equation, resulting in:

$$A'' = \frac{r}{\tau^2} + \frac{v}{\tau} + \frac{1}{2}a + \psi. \qquad \text{Eq. 134}$$

The offset vector $\psi$ can be a fixed vector that yields the margin required to avoid an accident. Alternatively, the offset vector $\psi$ may be a variable, such that the margin required to avoid an accident is a function of the velocities or accelerations of the vehicle and/or obstacle. In the simplest case of an automobile accident avoidance system, the acceleration command A" may be a braking command as many cars are equipped with automatic braking systems (ABS). The acceleration command A" may alternatively be implemented by using a guidance unit that causes a change in direction. Such a guidance unit could include applying the brakes in such a fashion so as to change the direction of the automobile or overriding the steering wheel.

Such accident avoidance systems may also be readily applied to other modes of transportation. For example, passenger airplanes, due to their high value in human life, would benefit from an accident avoidance system based upon the current invention. An airplane accident avoidance system could automatically cause an airplane to take evasive action, such as a turn, to avoid colliding with another airplane or other obstacle. Because the present invention includes velocity and acceleration effects in calculating an acceleration command, if the obstacle similarly takes evasive action, the magnitude of the action can be diminished. For example, if two airplanes have accident avoidance systems based upon the present invention, each airplane would sense changes in velocity and acceleration in the other airplane. This would permit each airplane to reduce the amount of banking required to avoid a collision.

While the above embodiments are based upon interactions between vehicles, the accident avoidance system could be separate from the vehicles. As an example, if an airport control tower included an accident avoidance system based upon the present invention, the system could warn air traffic controllers, who could relay warnings to the appropriate pilots. The airport control tower system would use the airplanes' velocities and accelerations and calculate the closest distance between the airplanes if they continue their present flight paths. If the predicted closest distance is less than desirable, the air traffic controllers can alert each pilot and recommend a steering direction based on Eq. 134. A busy harbor that must coordinate shipping traffic could employ a similar accident avoidance system.

Vehicle Guidance

As yet another embodiment of the present invention, such a system could be used for vehicle guidance. In particular, a vehicle guidance system would be beneficial in areas of high vehicle density. The vehicle guidance system would permit vehicles to be more closely spaced allowing greater traffic flow as each vehicle would be more accurately and safely guided. Returning to the example of airplanes, airplane guidance systems would permit more frequent take-offs and landings as the interaction between airplanes would be more tightly controlled. Such airplane guidance systems would also permit closer formations of airplanes in flight. Similar to an accident avoidance system, the airplane guidance system could generate an acceleration command to keep one airplane within a predetermined range of another airplane, perhaps when flying in formation.

While many of the above embodiments have an active system that generates an acceleration command, this need not be the case. The system, especially if it is of the accident avoidance or vehicle guidance types, may be passive and merely provide an operator with a warning or a suggested action. In a simple automobile accident avoidance system, the system may provide only a visible or audible warning of another automobile or obstacle. In an airplane, a more sophisticated guidance system may provide the suggestions of banking right and increasing altitude.

Although the present invention has been described by way of examples with reference to the accompanying drawings, it is to be noted that various changes and modifications will be apparent to those skilled in the art. Therefore, such changes and modifications should be construed as being within the scope of the invention.

What is claimed is:

1. A non-transitory computer readable medium encoded with computer executable code capable of being run on a computer for guiding a vehicle to a target, the computer executable code comprising:

computer executable code for determining a vehicle-to-target position vector r; computer executable code for determining a net vehicle-to-target velocity v; computer executable code for determining a net vehicle-to-target acceleration a; computer executable code for determining the time-to-go τ according to a first equation:

$$\frac{1}{2}a\cdot a\tau^3+\frac{3}{2}a\cdot v\tau^2+(a\cdot r+v\cdot v)\tau+v\cdot r=0;$$

computer executable code for determining an acceleration command A according to a second equation:

$$A=\frac{r}{\tau^2}+\frac{v}{\tau}+\frac{1}{2}a;$$

and computer executable code for generating control signals based upon the thus calculated acceleration command A.

2. A non-transitory computer readable medium in accordance with claim 1, wherein a time-to-go solution to the first equation is approximated by the equation:

$$\tau=\left(-\frac{e}{2}+\sqrt{\frac{e^2}{4}+\frac{d^3}{27}}\right)^{\frac{1}{3}}+\left(-\frac{e}{2}-\sqrt{\frac{e^2}{4}+\frac{d^3}{27}}\right)^{\frac{1}{3}}-\bar{v}\cos\gamma,$$

wherein:

$d=2(\bar{r}\cos\beta+\bar{v}^2)-3\bar{v}^2\cos^2\gamma$,
$e=2\bar{v}^3\cos^3\gamma-2\bar{v}\cos\gamma(\bar{r}\cos\beta+\bar{v}^2)+2\bar{v}\bar{r}\cos\alpha$,
$\bar{v}=v/a$,
$\cos\gamma=a\cdot v/av$,
$\bar{r}=r/a$,
$\cos\beta=a\cdot r/ar$,
$\cos\alpha=v\cdot r/vr$,
$a=|a|$, $a\neq 0$,
$v=|v|$, and
$r=|r|$.

3. A non-transitory computer readable medium in accordance with claim 1, wherein a time-to-go solution to the first equation is approximated by the equation:

$$\tau=2\sqrt{\frac{-d}{3}}\cos\left\{\frac{1}{3}\cos^{-1}\left(\frac{-e}{2\sqrt{-d^3/27}}+\varphi\right)\right\}-\bar{v}\cos\gamma,$$

wherein:

$d=2(\bar{r}\cos\beta+\bar{v}^2)-3\bar{v}^2\cos^2\gamma$,
$e=2\bar{v}^3\cos^3\gamma-2\bar{v}\cos\gamma(\bar{r}\cos\beta+\bar{v}^2)+2\bar{v}\bar{r}\cos\alpha$,
$\phi=0$, $2\pi/3$, or $4\pi/3$,
$\bar{v}=v/a$,
$\cos\gamma=a\cdot v/av$,
$\bar{r}=r/a$,
$\cos\beta=a\cdot r/ar$,
$\cos\alpha=v\cdot r/vr$,
$a=|a|$, $a\neq 0$,
$v=|v|$, and
$r=|r|$.

4. A non-transitory computer readable medium in accordance with claim 1, wherein a time-to-go solution to the first equation is approximated by the equation:

$$\tau=(r_0/v_0)f(N,\alpha_0),$$

wherein:

$r_0$ is an initial vehicle-to-target distance,
$v_0$ is an initial net vehicle-to-target speed, $$\cos\alpha_0=\frac{\dot{r}_0}{v_0},$$

and

N is a proportional navigation constant.

5. A non-transitory computer readable medium in accordance with claim 4, wherein $f(N,\alpha_0)$ is approximated by:

$$f(N,\alpha_0)=\sec\alpha_0\int_0^1\frac{d\bar{r}}{\sqrt{1+\frac{\tan^2\alpha_0}{N-1}(\bar{r}^{2N-2}-1)}},\quad\text{and}\quad\bar{r}=\frac{r}{r_0}.$$

6. A non-transitory computer readable medium in accordance with claim 4, wherein $f(N,\alpha_0)$ is approximated by:

$f(N,\alpha_0)\approx[1+p_1(N)\alpha_0+p_2(N)\alpha_0^2+p_3(N)\alpha_0^3+p_4(N)\alpha_0^4+p_5(N)\alpha_0^5]$, and $p_1(N)$, $p_2(N)$, $p_3(N)$, $p_4(N)$, and $p_5(N)$ are polynomials of N.

7. A non-transitory computer readable medium in accordance with claim 4, wherein f(N, $\alpha_0$) is approximated by:

$$f(N, \alpha_0) \approx \sec\alpha_0\left\{1 - \frac{\tan^2\alpha_0}{N-1}\right\}^{-\frac{1}{2}}\left\{1 - \frac{\tan^2\alpha_0}{2(2N-1)[(N-1)-\tan^2\alpha_0]}\right\}.$$

8. A non-transitory computer readable medium in accordance with claim 7, wherein $\tau \tan^2 \alpha_0 < (N-1)/2$.

9. A non-transitory computer readable medium in accordance with claim 4, wherein N>2.

10. A non-transitory computer readable medium in accordance with claim 4, wherein N is one of 3, 4, and 5.

11. The non-transitory computer readable medium of claim 10, wherein N is one of 3, 4, and 5.

12. A non-transitory computer readable medium including computer executable code capable of being run on a computer for guiding a vehicle to avoid an obstacle, the computer executable code comprising:

computer executable code for determining a vehicle-to-obstacle position vector r; computer executable code for determining a net vehicle-to-obstacle velocity v;

computer executable code for determining a net vehicle-to-obstacle acceleration a; computer executable code for determining the time-to-go $\tau$ between a current vehicle position and an obstacle position according to a first equation:

$$\frac{1}{2}a\cdot a\tau^3 + \frac{3}{2}a\cdot v\tau^2 + (a\cdot r + v\cdot v)\tau + v\cdot r = 0;$$

computer executable code for determining an offset vector $\Psi$to avoid an obstacle; computer executable code for determining an acceleration command A according to a second equation:

$$A = \frac{r}{\tau^2} + \frac{v}{\tau} + \frac{1}{2}a + \psi;$$

and computer executable code for generating a guidance signal based upon the thus determined acceleration command A.

13. A non-transitory computer readable medium in accordance with claim 12, wherein the guidance signal is at least one of an audible warning and a visual warning.

14. A non-transitory computer readable medium in accordance with claim 12, wherein the guidance signal is a braking command.

15. A method, comprising:

estimating a time-to-go to a target from a vehicle on a course to the target, the target having an actual acceleration;

adjusting the estimated time-to-go for the actual acceleration of the target; and modifying the course of the vehicle responsive to the acceleration adjusted estimated time-to-go.

16. The method of claim 15, wherein:

estimating the time-to-go includes determining a zero-effort-miss estimate; and adjusting for the actual acceleration results in zero-effort-miss with acceleration compensation guidance estimate.

17. The method of claim 15, wherein:

estimating the time-to-go includes determining a true proportional navigation estimate; and adjusting for the actual acceleration results in an augmented proportional navigation estimate.

18. The method of claim 15, further comprising acquiring the information from which the time-to-go is estimated.

19. The method of claim 18, wherein acquiring the information includes acquiring the vehicle-to-target vector, the vehicle-to-target velocity, and the vehicle-to-target acceleration.

20. The method of claim 18, wherein acquiring the information includes determining the information from a RADAR return signal or an optical return signal.

21. The method of claim 18, wherein acquiring the information includes receiving information from an external source.

22. The method of claim 18, wherein acquiring the information includes accessing at least a portion of the information from a memory.

23. The method of claim 15, wherein modifying the course of the vehicle includes modifying the course so that the vehicle intercepts the target.

24. The method of claim 15, wherein modifying the course of the vehicle includes modifying the course so that the vehicle avoids colliding with the target.

25. The method of claim 24, wherein modifying the course includes applying a minimum margin offset.

26. The method of claim 24, wherein modifying the course includes maintaining a safe distance relative to surrounding vehicles to avoid accidents.

27. The method of claim 24, wherein modifying the course includes maintaining an intercept course.

28. A non-transitory computer readable medium encoded with a instructions that, when executed by a processor, perform a method, the method comprising:

estimating a time-to-go from a vehicle to a target, the target having an actual acceleration; and adjusting the estimated time-to-go for the actual acceleration of the target.

29. The non-transitory computer readable medium of claim 28, wherein, in the method:

estimating the time-to-go includes determining a zero-effort-miss estimate; and adjusting for the actual acceleration results in zero-effort-miss with acceleration compensation guidance estimate.

30. The non-transitory computer readable medium of claim 28, wherein, in the method:

estimating the time-to-go includes determining a true proportional navigation estimate; and adjusting for the actual acceleration results in an augmented proportional navigation estimate.

31. The non-transitory computer readable medium of claim 28, wherein the method further comprises modifying the course of the vehicle responsive to the acceleration adjusted estimated time-to-go.

32. The non-transitory computer readable medium of claim 31, wherein modifying the course of the vehicle in the method includes modifying the course so that the vehicle intercepts the target.

33. The non-transitory computer readable medium of claim 31, wherein modifying the course of the vehicle in the method includes modifying the course so that the vehicle avoids colliding with the target.

34. The non-transitory computer readable medium of claim 31, wherein modifying the course in the method includes applying a minimum margin offset.

35. The non-transitory computer readable medium of claim 31, wherein modifying the course in the method includes maintaining a safe distance relative to surrounding vehicles to avoid accidents.

36. The non-transitory computer readable medium of claim 31, wherein modifying the course in the method includes maintaining an intercept course.

37. The non-transit readable medium of claim 28, wherein the target is an obstacle.

38. An apparatus, comprising:

a processor;

software that, when executed by the processor, performs a method comprising:

estimating a time-to-go from a vehicle to a target, the target having an actual acceleration;

adjusting the estimated time-to-go for the actual acceleration of the target; and iterating the estimating and adjusting over time.

39. The apparatus of claim 38, wherein, in the method:

estimating the time-to-go includes determining a zero-effort-miss estimate; and adjusting for the actual acceleration results in zero-effort-miss with acceleration compensation guidance estimate.

40. The apparatus of claim 38, wherein, in the method:

estimating the time-to-go includes determining a true proportional navigation estimate; and adjusting for the actual acceleration results in an augmented proportional navigation estimate.

41. The apparatus of claim 38, wherein the method further comprises modifying the course of the vehicle responsive to the acceleration adjusted estimated time-to-go.

42. The apparatus of claim 41, wherein modifying the course of the vehicle in the method includes modifying the course so that the vehicle intercepts the target.

43. The apparatus of claim 41, wherein modifying the course of the vehicle in the method includes modifying the course so that the vehicle avoids colliding with the target.

44. The apparatus of claim 41, wherein modifying the course in the method includes applying a minimum margin offset.

45. The apparatus of claim 41, wherein modifying the course in the method includes maintaining a safe distance relative to surrounding vehicles to avoid accidents.

46. The apparatus of claim 41, wherein modifying the course in the method includes maintaining an intercept course.

47. The apparatus of claim 38, wherein the target is an obstacle.

48. The apparatus of claim 38, further comprising an on-board RADAR sensor and in which the method further comprises acquiring data through the RADAR sensor on which the estimating and adjusting are performed.

49. The apparatus of claim 38, wherein the method further comprises acquiring data on which the estimating and adjusting are performed from an external source.

50. The apparatus of claim 38, wherein the method further comprises acquiring data on which the estimating and adjusting are performed from an on-board memory.

* * * * *